US008347558B2

(12) United States Patent
Whitten

(10) Patent No.: US 8,347,558 B2
(45) **Date of Patent: *Jan. 8, 2013**

(54) UNDER DECK DRAINAGE SYSTEM AND RELATED METHOD

(76) Inventor: Tim Whitten, Minnetonka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/495,517

(22) Filed: Jun. 13, 2012

(65) Prior Publication Data

US 2012/0247041 A1 Oct. 4, 2012

Related U.S. Application Data

(63) Continuation of application No. 12/355,358, filed on Jan. 16, 2009, now Pat. No. 8,245,451.

(60) Provisional application No. 61/021,813, filed on Jan. 17, 2008.

(51) Int. Cl.
*E04D 13/00* (2006.01)
*E04F 17/00* (2006.01)

(52) U.S. Cl. ..... 52/14; 52/302.1

(58) Field of Classification Search ..... 52/11, 14, 52/302.1, 302.3, 302.4, 506.06, 506.08, 512, 52/650.3, 654.1, 745.13

See application file for complete search history.

(56) References Cited

U.S. PATENT DOCUMENTS

| | | | | |
|---|---|---|---|---|
| 3,295,284 | A * | 1/1967 | Tschiesche | 52/506.07 |
| 3,332,186 | A | 7/1967 | Cammaert | |
| 3,903,671 | A * | 9/1975 | Cuin et al. | 52/480 |
| 4,494,346 | A * | 1/1985 | Gailey | 52/506.07 |
| 4,510,727 | A * | 4/1985 | Jury | 52/508 |
| 4,635,424 | A * | 1/1987 | Drapeau | 52/480 |
| 5,394,667 | A * | 3/1995 | Nystrom | 52/480 |
| 5,765,328 | A * | 6/1998 | Moore | 52/302.1 |
| 5,893,250 | A * | 4/1999 | Benvenuto et al. | 52/506.08 |
| 6,138,431 | A * | 10/2000 | da Encarnaçao | 52/763 |
| 6,343,450 | B1 | 2/2002 | Vance, Jr. | |
| 6,415,571 | B2 * | 7/2002 | Risser | 52/302.1 |
| 6,511,522 | B1 | 1/2003 | Gomez et al. | |
| 2002/0035811 | A1 | 3/2002 | Heuel | |
| 2006/0162262 | A1 * | 7/2006 | Smith | 52/58 |

FOREIGN PATENT DOCUMENTS

EP 55677 A2 * 7/1982

* cited by examiner

*Primary Examiner* — Christine T Cajilig
(74) *Attorney, Agent, or Firm* — Fredrikson & Byron, P.A.

(57) ABSTRACT

An under deck drainage system for use with a deck. The system includes at least one starter strip mounted to one or more joists of the deck, a plurality of clips coupled with the starter strip, where the clips are slidable along the starter strip. The system further includes an elongate channel member coupled with at least one of the plurality of clips, and the elongate channel member has at least one channel therein.

16 Claims, 8 Drawing Sheets

UNDER DECK DRAINAGE SYSTEM AND RELATED METHOD

CROSS-REFERENCE TO RELATED APPLICATIONS

This application is a continuation of U.S. application Ser. No. 12/355,358, filed Jan. 16, 2009, which claims the benefit of U.S. Provisional Application Ser. No. 61/021,813, filed on Jan. 17, 2008, which are hereby incorporated by reference in their entirety.

TECHNICAL FIELD

This relates to the field of decking, and more specifically, to an under deck drainage system.

BACKGROUND

Elevated decks provide for space below the deck which can be used and enjoyed as outdoor space. However, during inclement weather, such as rain, the weather can frustrate the ability to enjoy the space as water can fall through the spaces between adjacent deck boards.

SUMMARY

An under deck drainage system for use with a deck. The system includes at least one starter strip mounted to one or more joists of the deck, a plurality of clips coupled with the starter strip, where the clips are optionally slidable along the starter strip. The system further includes an elongate channel member coupled with at least one of the plurality of clips, for example, with an outer portion of the clips. The elongate channel member has at least one channel therein, which can allow for drainage of fluids. In an option, the clips are slidable within the elongate channel member, and/or connected with the elongate channel member with a snap fit connection. In yet another option, the plurality of clips is connected with the starter strip with a snap fit connection.

In another embodiment, a method includes coupling one or more starter strips with one or more joists of a deck, including coupling the starter strips parallel with a first axis. The method further includes coupling one or more clips with the one or more starter strips, including sliding the one or more clips parallel with the first axis, and coupling a plurality of elongate channel members with at least a portion of the one or more clips, where the elongate channel member having at least one channel therein. Coupling the plurality of elongate channel members includes coupling the elongate channel members parallel with a second axis.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1A:
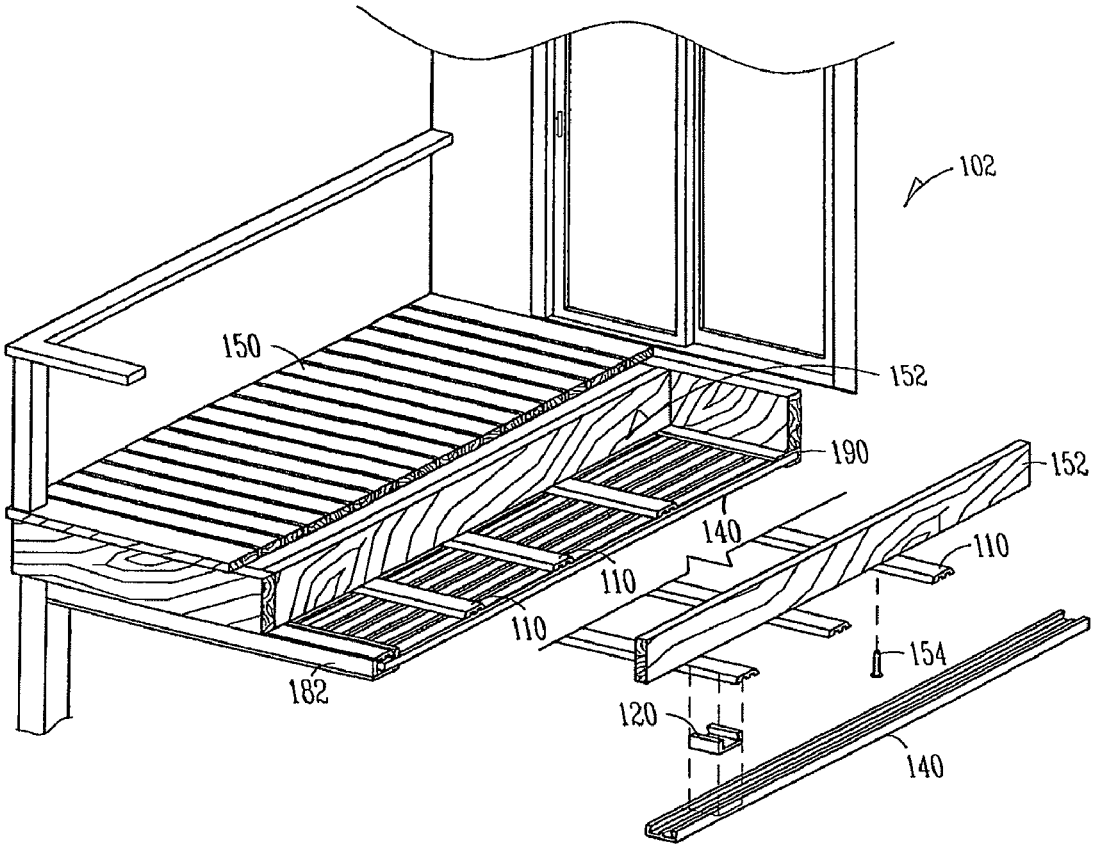
FIG. 1A illustrates an under deck drainage system in accordance with at least one embodiment.
Figure 1B:
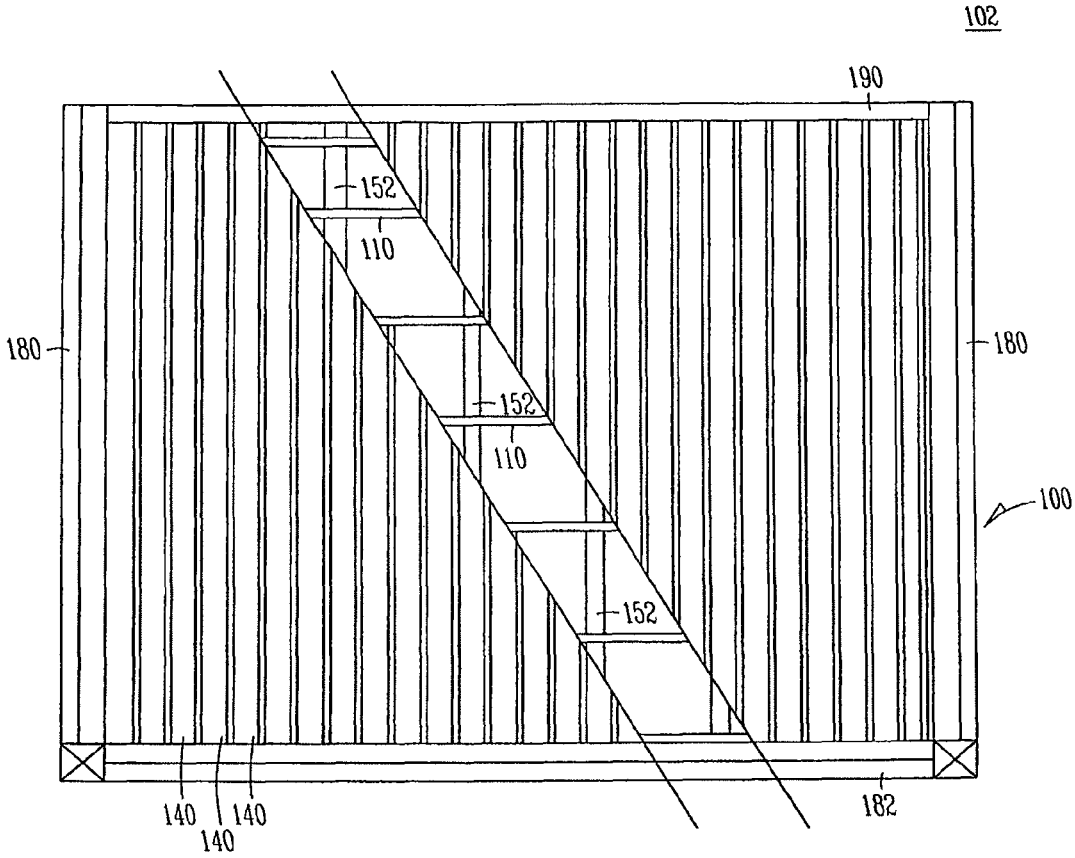
FIG. 1B illustrates a portion of an under deck drainage system in accordance with at least one embodiment.
Figure 2:
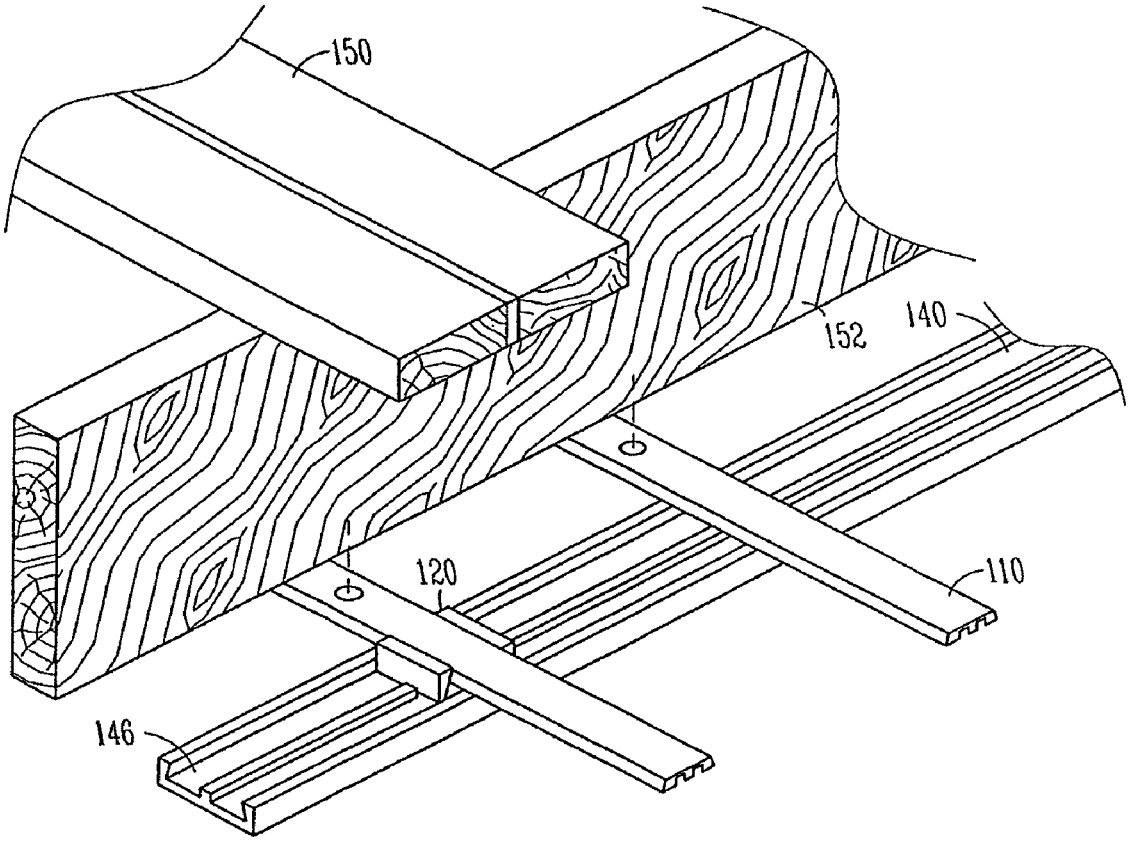
FIG. 2 illustrates an exploded portion of an under deck drainage system in accordance with at least one embodiment.

An under deck drainage system 100 is illustrated in FIGS. 1A, 1B, and 2. The system 100 is for use with a deck and allows for preventing water and debris from dropping through the deck and to the space below the deck, for instance at a single family home, or multi-family home, or screened porches. This allows for a home owner to use the area below the deck during inclement weather, for example, when it is raining, and can prevent bugs from coming up through the decking into a screened porch. Furthermore, the system 100 assists in moving water and debris away from a structure, and provides a neat appearance for the under side of a deck. The system 100, or portions thereof, is also removable, allowing for cleaning, for example, with a leaf blower or a power washer. System 100 can also work with joists of a deck extending in either direction.

The deck is disposed adjacent a building, such as a house 102, and typically includes decking 150 supported by joists 152. The system 100 includes one or more starter strips 110, one or more clips 120, and one or more channel members 140. The system 100 optionally further includes front trim 182 (FIG. 8), side trim 180, and back trim 190. The front trim 182, or back trim 190 are optionally coupled with the channel member, such as with a lower portion of the channel member. The side trim 180 is optionally coupled with at least one clip, and the side trim is mounted over an edge of at least one channel member. The channel member, starter strips, front, side, and/or back trim can be formed for example of plastic, composite material, or light weight aluminum, and made via extrusion that is cut to length.

The starter strips 110 are mounted to one or more joists of the deck, such as shown in FIG. 2. The starter strips 110, in an option, are elongate and have a longitudinal axis. The starter strips 110 are disposed such that the longitudinal axis is generally transverse to the lengths of the joists 152, as shown in *Figure* 2. The starter strips 110 can also be disposed at other angles relative to the joists, such as, but not limited to parallel, or at an oblique angle to the joists. The starter strips 110 are coupled with the joists 152, for instance, the starter strips 110 are directly coupled with the joists 152. In an option, the starter strips 110 are coupled with a lower portion of the joists 152, or a bottom surface of the joists 152. The starter strips, in another option, are coupled with the joists with a fastener, such as a screw 154 disposed through an upper portion 116 of the strips 110.

Figure 3:
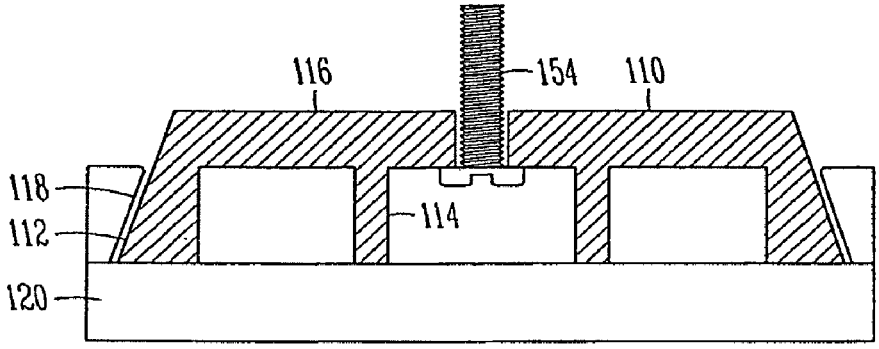
FIG. 3 illustrates a cross-section of a starter strip in accordance with at least one embodiment.

The one or more starter strips 110, as shown in cross-section in FIG. 3, optionally includes structure 112 that allows for the strips 110 to be connected with the clip 120 such that the clip 120 is slidable relative to the starter strip 110. In an option, the clip 120 is coupled with the starter strips 110 with a snap fit connection, and yet allows for the clip 120 to be slidable along the starter strip 110. For instance, the outer portion of the strips 110 include tapered flanges 118 that interconnect with the clips 120. In a further option, the strips 110 include members 114 extending from an inner surface, providing for stability to span the joists.

Figure 4:
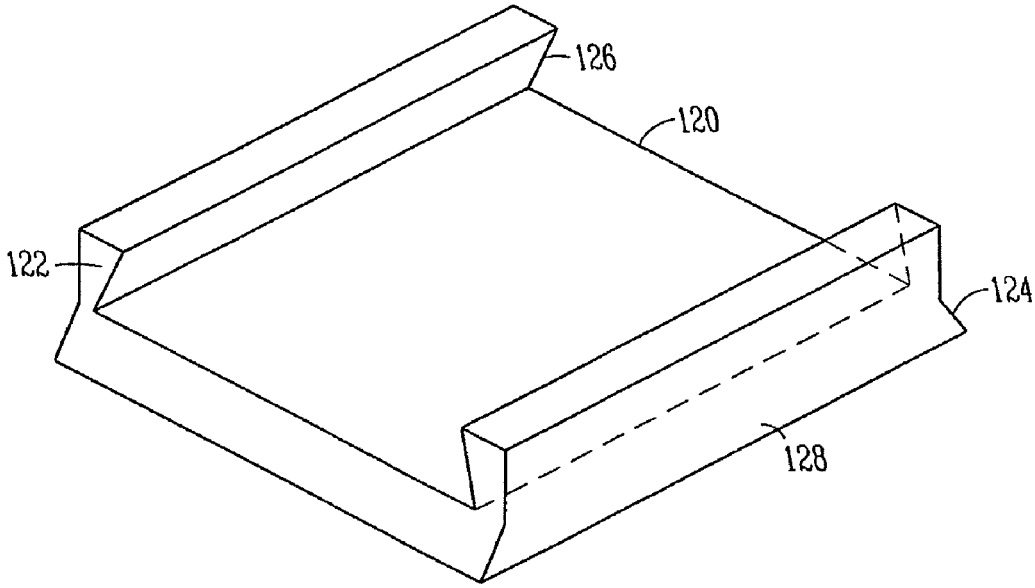
FIG. 4 illustrates a view of a clip in accordance with at least one embodiment.

The starter strips 110 are coupled with the clips 120, where the clip 120 is shown in greater detail in FIG. 4. The clip 120 has multiple coupling portions, in an option. For instance, the clip 120 includes an upper coupling portion 122, and a lower coupling portion 124. The upper coupling portion 122 couples with the starter strips 110, for example within the starter strip 110, and the lower coupling portion 124 couples with the channel member 140, for example, around an outer surface of the channel member 140. In an option, the upper coupling portion 122 allows for the clips 120 to connect with the starter strip 110 with a snap fit connection, and/or allows for the clips 120 to slide along the starter strips 110, assisting with ease of installation. In a further option, the lower coupling portion 124 allows for the clips 120 to connect with the channel member 140 with a snap fit connection, and/or allows for the clips 120 to slide along the channel member 140, also assisting with ease of installation, or ease of removal for cleaning. This also allows for the clips 120 to slide in multiple directions, for example, along two different axes that may be transverse to one another. The clips, in an option, can be formed of plastic and/or composite material, for example via injection molding.

The clips 120 can be slid in two different axes relative to the joists, in an option. For instance, the clips 120 can slide along the starter strips 110 along a first axis that is generally transverse to the axis of the joists, where the starter strips 110 are disposed generally transverse to the joists. The clips 120 can slide along the channel member 140 along a second axis that is generally parallel with the joists, where the channel members 140 are disposed parallel with the joists.

Figure 9:
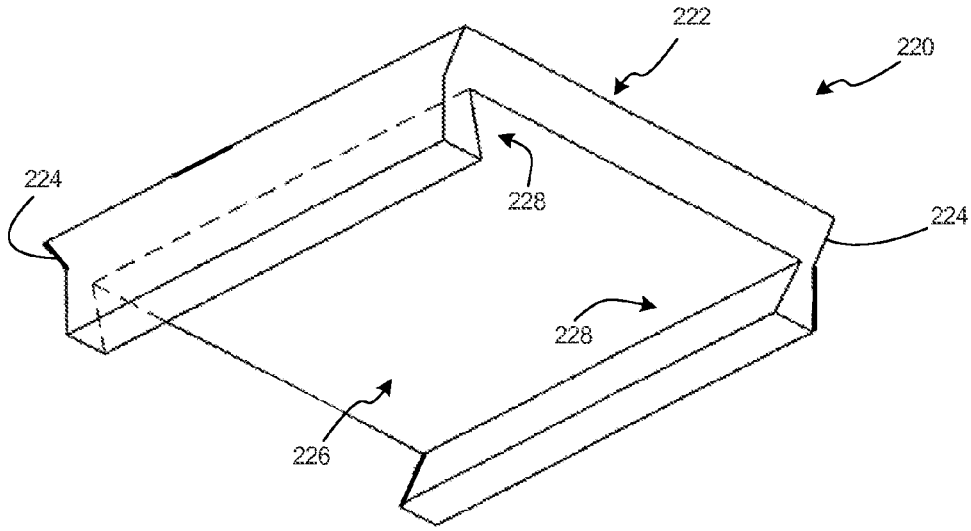
FIG. 9 illustrates a view of a clip in accordance with another embodiment.
Figure 10:
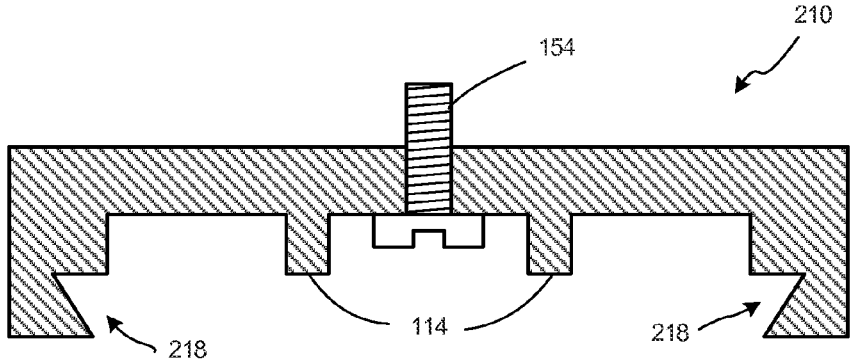
FIG. 10 illustrates a cross-section of a starter strip in accordance with another embodiment.
Figure 11:
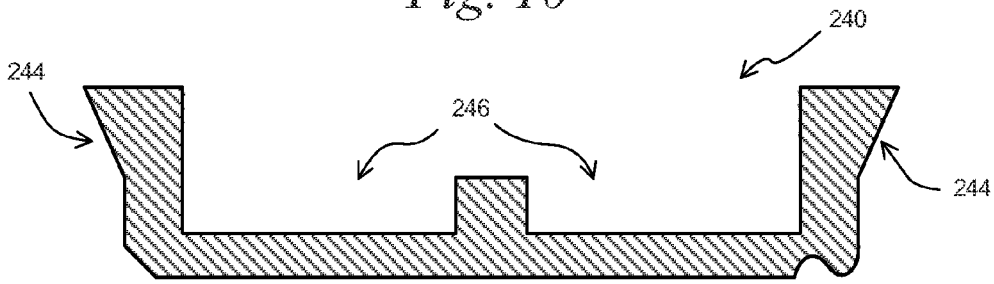
FIG. 11 illustrates a cross-sectional view of a channel member in accordance with another embodiment.

In an option, the upper coupling portion 122 includes a tapered flange 126 that couples with the tapered flange of the starter strips. In another option, the lower coupling portion 124 includes a tapered flange 128 that couples with a portion of the channel member 140. The upper coupling portion 122 provides, in an option, an internal feature for coupling with an exterior feature of the starter strips 110. The lower coupling portion 124 includes, in another option, an external feature for coupling with an internal feature of the channel member 140. These features can be reversed such that external couplings can be internal, and vice versa. For instance, as illustrated in FIG. 9, upper coupling portion 222 of clip 220 includes an exterior feature configured as tapered flange 224 and lower coupling portion 226 of clip 220 includes an interior feature configured as tapered recess 228. Accordingly, as illustrated in FIGS. 10 and 11, respectively, starter strip 210 includes an internal feature configured as tapered recess 218 and channel member 240 includes an exterior feature configured as tapered flange 244. As will be apparent to one skilled in the art, tapered flange 224 on upper coupling portion 222 and tapered recess 218 of starter strip 210 are configured for coupling with one another, and tapered recess 228 on lower coupling portion 226 and tapered flange 244 of channel member 240 are configured for coupling with one another. All variants of the described and/or illustrated embodiments for coupling the starter strips and the channel members are considered as being within the metes and bounds of the instant invention.

Figure 5:
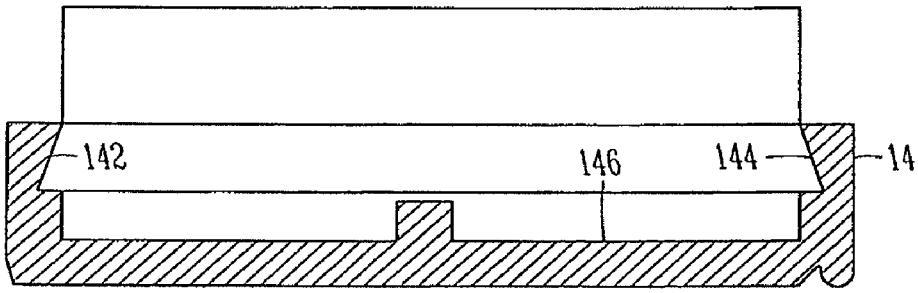
FIG. 5 illustrates a cross-sectional view of a channel member in accordance with at least one embodiment.
Figure 6:
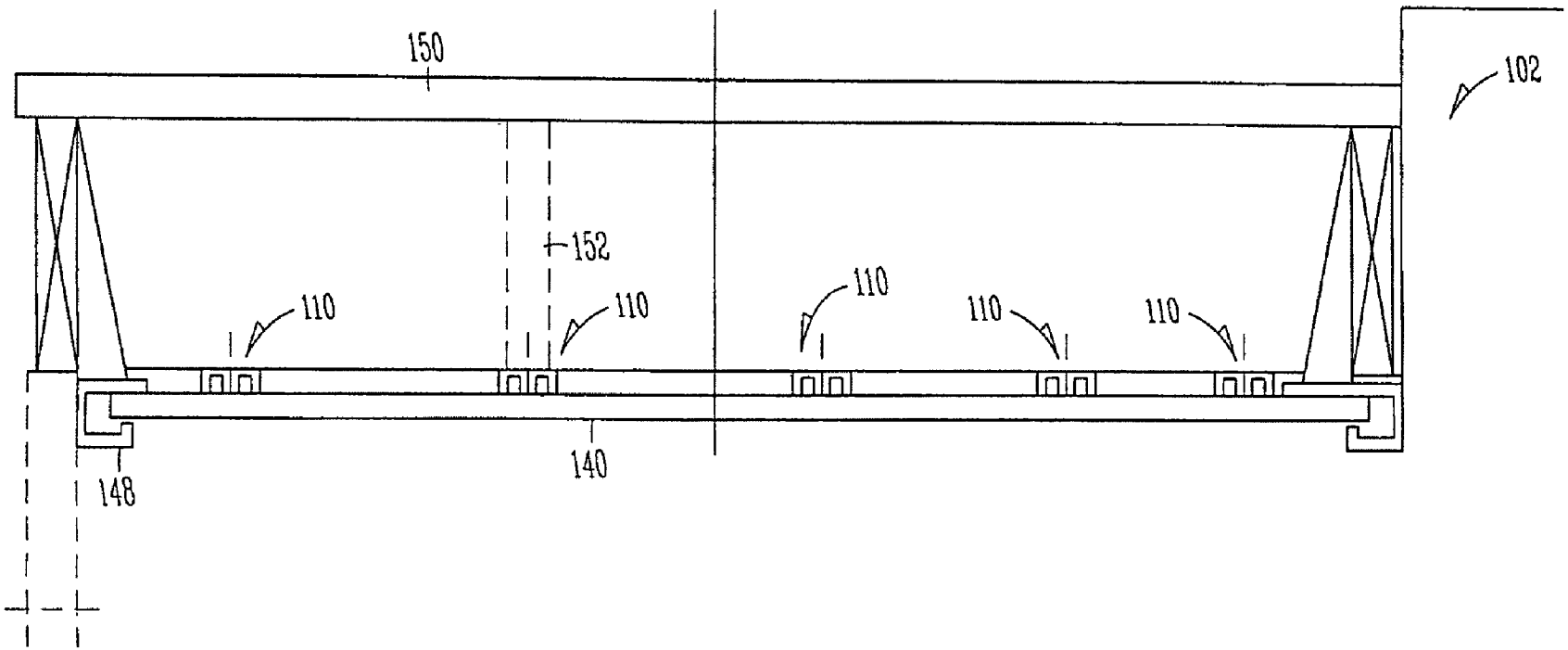
FIG. 6 illustrates a portion of an under deck drainage system in accordance with at least one embodiment.

The clip 120 couples with an elongate channel member 140, where a plurality of channel members 140 are placed side by side to cover the joists (FIGS. 1 and 2). The channel member 140 is shown in cross-section in FIG. 5 and includes a coupling portion 142 that allows for the channel member 140 to couple with a portion of the clip 120, and further includes one or more channels 146, allowing for drainage. As shown in FIG. 6, the one or more channels 146, in an option, are sloped away from the building to which the deck is attached. A gutter 148 can be connected with the channels 146, allowing for further drainage for the system 100.

In a further option, the channel member 140 includes an inner tapered recess 144 that couples with the tapered flange 128, for example, with a snap fit connection. Other types of connections can also be incorporated herein. The channel member 140 can be formed, for example, by extrusion, of plastic or PVC, and can be removed from the one or more clips 120, allowing for the system to be cleaned. The channel member 140 can be made in a variety of colors, allowing for coordination with other building components.

The channel member 140 can also be made of other materials, such as, but not limited to, metal. In a further option, a bottom visible portion of the channel member 140 can be given different structure, or grooves to simulate other materials. For example, the channel member 140 can be given a beaded board look.

Figure 7:
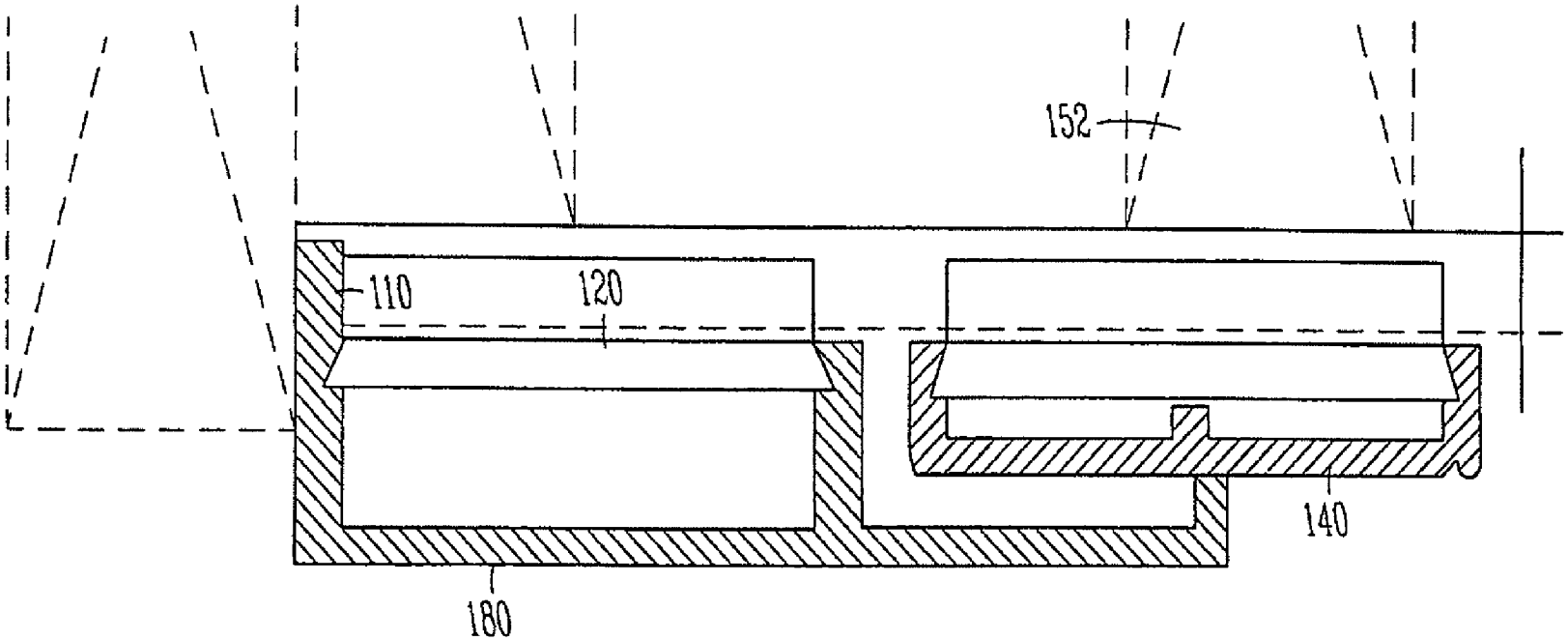
FIG. 7 illustrates a cross-sectional portion of an under deck drainage system in accordance with at least one embodiment.
Figure 8:
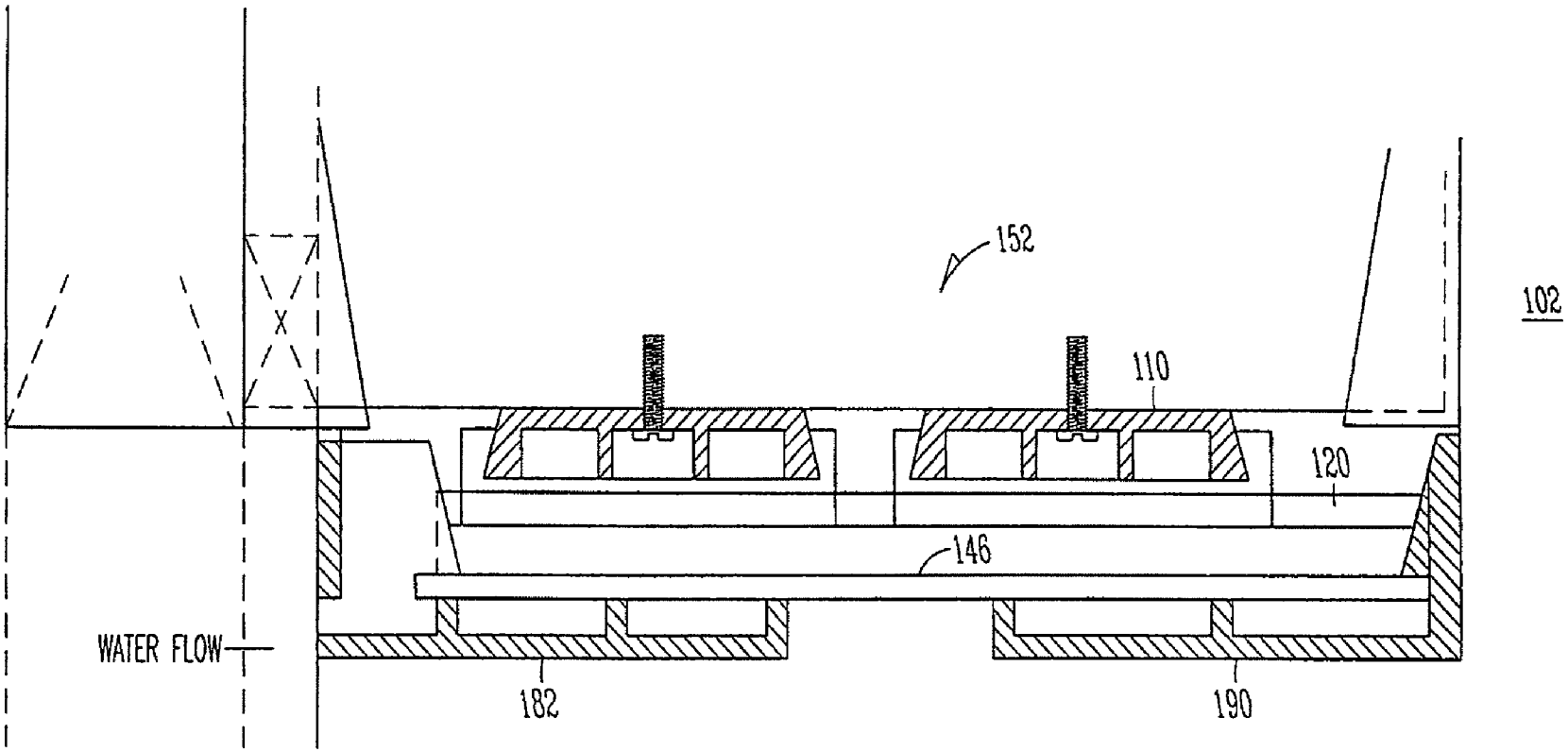
FIG. 8 illustrates a cross-sectional portion of an under deck drainage system in accordance with at least one embodiment.

The system 100 can further include one or more trims, as shown, for example, in FIGS. 7 and 8. The trims allow for the system 100 to be provided with a more finished look, and yet permit water to drain from the system 100 and deck. FIG. 7 illustrates an example of a side trim 180 that is coupled with at least one clip 120 and covers an edge of at least one channel member 140.

Installation of the under deck system 100 can be done as follows. A method includes coupling one or more starter strips with one or more joists of a deck, including coupling the starter strips parallel with a first axis. The method further includes coupling one or more clips with the one or more starter strips, for instance snap fittedly coupling the clips with the one or more starter strips. The method still further includes sliding the one or more clips parallel with the first axis, and coupling a plurality of elongate channel members with at least a portion of the one or more clips, where the elongate channel member has at least one channel therein. Coupling the plurality of elongate channel members includes coupling the elongate channel members parallel with a second axis, and/or coupling the elongate channel members with the one or more clips includes snap-fittedly coupling the channel members with the one or more clips.

Further options for the methods are as follows. For instance, the elongate channel members can be slid along the second axis, and optionally the second axis is substantially transverse to the first axis. In another option, the method further includes draining fluid through the at least one channel. In another option, the joists include a lower surface, and coupling the one or more starter strips with the one or more joists includes coupling the starter strips directly with the lower surface of joists.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. An under deck system comprising one or more starter strips, each comprising a tapered recess and configured for being mounted to one or more joists of said deck;

one or more channel members, each comprising a tapered flange and one or more channels for drainage; and one or more clips, each comprising an upper coupling portion comprising a tapered flange for coupling with said tapered recess of one of said starter strips; and a lower coupling portion comprising a tapered recess for coupling with said tapered flange of one of said channel members.

2. The system of claim 1, wherein said upper coupling portion is slidable along a length of said starter strips; and said lower coupling portion is slidable along a length of said channel members.

3. The system of claim 1, wherein said upper coupling portion of said one or more clips is coupled to one of said one or more starter strips with a snap fit connection; and said lower coupling portion of said one or more clips is coupled to one of said one or more channel members with a snap fit connection.

4. The system of claim 1, wherein said tapered recess of said starter strips comprises opposing side surfaces;

said tapered flange of said channel members comprises opposing side surfaces said tapered flange of said upper coupling portion comprises opposing side surfaces; and said tapered recess of said lower coupling portion comprises opposing side surfaces.

5. The system of claim 4, wherein said opposing side surfaces of said starter strips and said opposing side surfaces of said upper coupling portion are configured as mating surfaces; and said opposing side surfaces of said channel members and said opposing side surfaces of said lower coupling portion are configured as mating surfaces.

6. The system of claim 1, comprising a front trim spanning across a first end of said channel member(s) and coupled with a lower portion of at least one channel member.

7. The system of claim 1, comprising at least one side trim coupled to said lower coupling portion of at least one of said clips; and mounted over an edge of at least one of said channel members.

8. The system of claim 1, comprising a back trim spanning across a second end of said channel members and coupled with a lower portion of at least one channel member.

9. A method for installing an under deck system, comprising:

providing one or more starter strips, each comprising a tapered recess and configured for being mounted to one or more joists of said deck;

providing one or more channel members, each comprising a tapered flange and one or more channels for drainage;

providing one or more clips, each comprising an upper coupling portion comprising a tapered flange for coupling with said tapered recess of one of said starter strips; and a lower coupling portion comprising a tapered recess for coupling with said tapered flange of one of said channel members;

mounting said one or more starter strips to one or more joists of said deck;

coupling said upper coupling portion of said clips with said starter strips; and coupling said lower coupling portion of said clips with said channel members.

10. The method of claim 9, wherein coupling said upper coupling portion with said starter strip comprises a snap fitting; and coupling said lower coupling portion with said channel member comprises a snap fitting.

11. The method of claim 9, wherein coupling said upper coupling portion with said starter strip comprises a slidable coupling for slidably moving said clips along a length of said starter strip; and coupling said lower coupling portion with said channel member comprises a slidable coupling for slidably moving said clips along a length of said channel member.

12. The method of claim 11, comprising moving said channel members relative to said starter strips; and positioning one channel member adjacent another channel member.

13. The method of claim 12, wherein moving said channel members comprises sliding said clips along said length of said starter strip; and sliding said channel member along its length.

14. The method of claim 12, comprising providing a front trim spanning across a first end of said channel members; and coupling said front trim with a lower portion of at least one channel member.

15. The method of claim 12, comprising providing one or more side trims;

coupling each side trim to said lower coupling portion of said one or more clips; and mounting each side trim over an edge of said one or more channel members.

16. The method of claim 12, comprising providing a back trim spanning across a second end of said channel members; and coupling said back trim with a lower portion of at least one channel member.

* * * * *